US011565432B2

(12) United States Patent
Rohrbach et al.

(10) Patent No.: US 11,565,432 B2
(45) Date of Patent: Jan. 31, 2023

(54) UTILITY KNIFE

(71) Applicant: MARTOR KG, Solingen (DE)

(72) Inventors: Martin Rohrbach, Goegginen-Horn (DE); Kerry Henn, Solingen (DE)

(73) Assignee: MARTOR KG, Solingen (DE)

( * ) Notice: Subject to any disclaimer, the term of this patent is extended or adjusted under 35 U.S.C. 154(b) by 79 days.

(21) Appl. No.: 16/374,552

(22) Filed: Apr. 3, 2019

(65) Prior Publication Data

US 2020/0023528 A1 Jan. 23, 2020

(30) Foreign Application Priority Data

Jul. 17, 2018 (DE) ..... 102018117203.6

(51) Int. Cl.
*B26B 5/00* (2006.01)

(52) U.S. Cl.
CPC ..... *B26B 5/003* (2013.01)

(58) Field of Classification Search
CPC ..... B26B 1/08; B26B 5/001; B26B 5/003; B26B 5/005
USPC ..... 30/162, 335, 336
See application file for complete search history.

(56) References Cited

U.S. PATENT DOCUMENTS 3,641,667 A * 2/1972 Leopoldi ..... B26B 27/005 30/2
4,683,656 A * 8/1987 Peyrot ..... B26B 5/003 30/162
4,713,885 A * 12/1987 Keklak ..... B26B 5/003 30/162
4,757,612 A * 7/1988 Peyrot ..... B26B 29/02 30/151
5,303,474 A * 4/1994 Keklak ..... B26B 5/003 30/162
6,148,520 A * 11/2000 Berns ..... B26B 5/003 30/162

(Continued)

FOREIGN PATENT DOCUMENTS

DE 20210670 U1 9/2002
DE 20210670 U1 10/2002

(Continued)

OTHER PUBLICATIONS

European Search Report for European Publication EP 3597379, dated Oct. 18, 2019.*

(Continued)

*Primary Examiner* — Jason Daniel Prone
(74) *Attorney, Agent, or Firm* — Andrew Wilford

(57) ABSTRACT

A utility knife has a housing having a longitudinally open front end, a blade assembly including a blade and movable in the housing between a front end position and a rear end safety position, and a lever pivoted on the housing. Two links each have one end pivoted on the blade assembly and an opposite end pivotal on the lever so as to pivotally interconnect the blade assembly and the lever for relative movement of the blade assembly and the housing between the rear end safety position with the blade inside the housing and the front end position with the blade projecting longitudinally forward from the front end of the housing. A spring is connected to the links urges the blade assembly into the rear end safety position.

8 Claims, 10 Drawing Sheets

(56) References Cited

U.S. PATENT DOCUMENTS 6,487,778 B1 * 12/2002 Gringer et al. ..... B26B 5/003 30/162
6,643,936 B2 * 11/2003 Carlson ..... B26B 25/005 30/162
6,813,833 B2 * 11/2004 Saunders ..... B26B 5/003 30/162
6,898,858 B1 5/2005 Spell
8,056,241 B2 * 11/2011 Davis ..... B26B 5/003 30/162
8,122,605 B2 * 2/2012 Votolato ..... B26B 5/003 30/2
8,220,160 B2 * 7/2012 Davis ..... B26B 3/06 30/162
8,250,764 B2 * 8/2012 Davis ..... B26B 5/003 30/162
8,307,556 B2 * 11/2012 Davis ..... B26B 5/003 30/162
8,347,509 B2 * 1/2013 Votolato ..... B26B 5/00 30/151
8,353,109 B2 * 1/2013 Rohrbach ..... B26B 5/003 30/162
8,707,566 B2 * 4/2014 Rohrbach ..... B26B 5/003 30/162
8,732,957 B2 * 5/2014 Rohrbach ..... B26B 5/003 30/154
8,752,297 B2 * 6/2014 Rohrbach ..... B26B 5/003 30/154
8,776,380 B1 * 7/2014 Quimby ..... B26B 5/003 30/158
8,931,180 B2 * 1/2015 Davis ..... B26B 5/003 30/162
9,003,668 B2 * 4/2015 Landwehr ..... B26B 5/00 30/286
D743,235 S * 11/2015 Rohrbach ..... D8/99
9,174,347 B2 11/2015 Hongquan et al.
9,370,869 B2 6/2016 Hongquan et al.
9,808,941 B2 * 11/2017 Jacobs ..... B26B 5/003
9,908,247 B2 * 3/2018 Herlitz ..... B26B 1/08
10,245,736 B2 * 4/2019 Huang ..... B26B 5/001
10,583,572 B2 * 3/2020 Herlitz ..... B26B 1/08
10,800,053 B1 * 10/2020 Liu ..... B26B 5/003
10,994,429 B2 * 5/2021 Wang ..... B26B 5/001
10,994,434 B2 * 5/2021 Rohrbach ..... B26B 5/00
11,084,178 B2 * 8/2021 Huang ..... B26B 5/003
11,097,434 B2 * 8/2021 Hooper ..... B26B 5/003
11,254,020 B2 * 2/2022 Liu ..... B26B 5/003
11,376,751 B2 * 7/2022 Rohrbach ..... B26B 5/001
11,446,834 B2 * 9/2022 Liu ..... B26B 5/003
2002/0124418 A1 * 9/2002 Votolato ..... B26B 5/001 30/294
2003/0154606 A1 * 8/2003 Saunders et al. ..... B26B 5/003 30/162
2004/0237312 A1 * 12/2004 Hernandez et al. .... B26B 5/003 30/162
2008/0163493 A1 * 7/2008 Votolato ..... B26B 5/003 30/154
2008/0282547 A1 * 11/2008 Leger ..... B26B 5/001 30/162
2010/0088900 A1 * 4/2010 Davis et al. ..... B26B 5/003 30/162
2010/0319200 A1 * 12/2010 Davis et al. ..... B26B 5/003 30/162
2011/0035947 A1 * 2/2011 Rohrbach ..... B26B 5/003 30/162
2013/0185943 A1 * 7/2013 Landwehr ..... B26B 29/02 30/153
2013/0239415 A1 * 9/2013 Wagner ..... B26B 5/002 30/162
2016/0279811 A1 * 9/2016 Huang et al. ..... B26B 1/08
2016/0325442 A1 * 11/2016 Herlitz ..... B26B 1/08
2017/0203448 A1 7/2017 Jacobs et al.
2018/0311839 A1 * 11/2018 Huang ..... B26B 5/001
2020/0338767 A1 * 10/2020 Rohrbach ..... B26B 5/003

FOREIGN PATENT DOCUMENTS

DE 202015102604 U1 7/2015
EP 1946897 A1 7/2008
EP 2 314 430 B1 * 5/2017 ..... B26B 5/003

OTHER PUBLICATIONS

European Search Opinion for European Publication EP 3597379, dated Oct. 18, 2019.*
English translation of European Search Report for European Publication EP 3597379, dated Oct. 18, 2019 (machine translation using Google Translation), 3 documents corresponding to 3 pages of translation.*

* cited by examiner

UTILITY KNIFE

FIELD OF THE INVENTION

The invention relates to a utility knife.

BACKGROUND OF THE INVENTION

A utility knife of this kind is known from U.S. Pat. No. 9,370,869. This utility knife comprises a blade support holding a blade and mounted on a housing by two links such that the blade support is movable between a safety position in which the blade is recessed in the housing and a cutting position in which the blade projects from the housing. The housing, the link and the blade support form a four-bar linkage. The links are arranged so as to be mutually parallel as a result of which the utility knife forms a parallelogrammatic four-bar linkage.

OBJECT OF THE INVENTION

The object of the invention was that of providing a utility knife that has advantageous properties with respect to the course of movement of the blade support.

SUMMARY OF THE INVENTION

The object is attained by a utility knife comprising a lever and a housing that is mounted so as to be able to perform a relative movement with respect to the lever. By relative movement between the lever and the housing, the blade assembly can be moved for example between the rear end position and the front end position. Alternatively, owing to the relative movement of the lever with respect to the housing, the blade assembly can be moved between the rear end position and a position between the rear end position and the front end position.

The utility knife further comprises a blade assembly. The blade assembly comprises for example a blade support and a blade that is held on the blade support. Alternatively, the blade assembly may also merely comprise a blade.

Furthermore, the utility knife comprises an actuator. The blade can be moved between at least one rear end position and at least one front end position using the actuator. The rear end position is for example a safety position, and the front end position is for example a cutting position. In the safety position, the blade is received in a housing such that the user cannot injure themselves. In the cutting position, the blade projects from the housing such that it is possible to perform a cutting process.

The actuator comprises at least one first link and one second link, wherein each link together with the blade assembly and with the lever or with the housing forms a pivot such that a mechanical linkage is formed. The blade is for example directly or indirectly connected to the links. For example, the blade is firmly held in a blade holder. The links in each case form a pivot, for example together with the blade holder. According to an alternative, each link forms a pivot directly together with the blade.

The blade assembly and the link are guided for example only by the pivots. According to an alternative, the blade assembly and the link are guided only by the pivots on the lever and by one pivot of a brace or support element that connects the link to the housing. The pivots are formed as revolute pivots for example. In this way, the blade assembly is guided with respect to all spatial directions during movement between the rear position and the front position.

The features according to the invention make it possible for the blade support to be moved between the rear end position and the cutting position in an imaginary enveloping tunnel having a small cross-sectional area. As a result, a small housing can be constructed that simultaneously forms a handle.

The above-mentioned features furthermore make it possible to achieve significant movement in relation to the operating movement.

The guidance by the pivots means that there is little friction, as a result of which effortless movement between the rear position and the front position takes place.

The actuator forms for example a four-bar linkage. The lever and the blade assembly are for example part of the four-bar linkage. Two links for example connect the lever and the blade assembly. In addition to the four-bar linkage, the mechanical linkage may also comprise further links. For example, the housing is likewise part of the mechanical linkage. The housing can for example also form a link. The housing is for example directly or indirectly movably connected to the four-bar linkage.

For example, at least one pair of links of the four-bar linkage are mutually parallel. Two links that interconnect the lever and the blade assembly are parallel for example. In this case, for example a parallelogram four-bar linkage can be formed.

According to an alternative, the links of the mechanical linkage are not arranged so as to be parallel. For example, the mechanical linkage may comprise an asymmetrical four-bar linkage. An asymmetrical four-bar linkage makes it possible for movement path of the blade assembly to be changed during movement between the rear position and the front position. These features make it possible for the blade to move between the safety position and the cutting position in a narrow movement tunnel.

According to an embodiment, at least two links of the mechanical linkage are of different lengths. For example, two links that interconnect the lever and the blade are of different lengths. These features too make it possible for movement path and the position of the blade relative to the lever and/or the housing to be changed.

Each link of the actuator for example has just one direction of rotation during movement between the safety position and the cutting position. In other words, each link maintains the direction of rotation thereof and does not change the direction of rotation thereof during movement between the safety position and the cutting position.

According to an embodiment, at least two links of the actuator have the same direction of rotation during movement between the safety position and the cutting position. That is to say that the direction of rotation of one link has the same rotational orientation at least with respect to the direction of rotation of a second link.

An embodiment is characterized in that the blade assembly performs just a small pivot movement of $\alpha<45°$ or of $\alpha<30°$ or of $\alpha<10°$ or of $\alpha<5°$ during movement between the rear end position and the front end position. This feature ensures that the housing can be designed so as to be slim. Furthermore it is possible for the blade to carry out just a small angular change after emerging from the housing. This means that the risk of injury is low. In the case of knives from the prior art, the blade performs a large rotational movement of for example 50° after emerging from the housing. There was a relatively high risk of injury in the case of these knives.

Alternatively, for example the housing is displaceable relative to the lever.

The lever or the housing forms for example at least one slide that is movable relative to the other part in each case, i.e. relative to the housing or the lever. The slide is movably connected to the blade support. The slide is for example connected to the blade assembly or to at least one link or can be brought into contact with the blade such that the blade is movable between the safety position and the cutting position. For example, a slide for actuating the blade is provided on the opposite face of the utility knife. Alternatively, a slide may be provided on three utility knife faces, for example on the back of a utility knife and on opposite flanks of the utility knife. According to an alternative, the slide may also be molded onto the blade support or integrally connected thereto. The user can move the blade support by the slide.

According to an alternative, the housing is formed by a lever that together with the lever forms a pivot. The lever acts for example on the blade assembly or on at least one link of the actuator. In this way, for example, the lever and the housing can form a pincer-like actuator. The lever and the housing can for example be formed by two hingedly interconnected handle parts that are movable in the manner of pincers.

According to an embodiment, the blade is recessed in the housing in the safety position such that a user cannot come into contact with the cutting edge. It is important here for the housing to prevent injury on the blade. Impairment of the functional parts can also be prevented by the housing. The housing therefore does not have to be completely closed. It just simply fulfil the above-mentioned functions. The function can be fulfilled by a wire framework for example. The housing should for example be designed such that it can function as a handle of the utility knife. For example, the housing should be designed such that the user can firmly hold the handle and optionally grip all around the handle in the process without changing his grip during movement of the blade between the rear end position and the front end position.

In order to achieve this, it is advantageous for the blade to emerge from the housing only in a small region of the housing such that the blade can move out of the housing in this region without impeding the user when this user holds the utility knife by the handle.

In order to move the mechanical linkage, the housing is directly or indirectly movably connected to the mechanical linkage. For example, two links are connected to the lever and to the blade assembly in each case by a pivot. A support element is for example connected to the link of the mechanical linkage and to the housing such that a torque is generated about one of the pivots of the mechanical linkage during a relative movement between the lever and the housing, which torque moves the mechanical linkage. In this manner, the blade is movable for example between the end positions.

According to an embodiment, the lever is pivotable relative to the housing out of a home position in a first direction into an actuated position in order to move the blade support into the cutting position.

BRIEF DESCRIPTION OF THE DRAWING

Further advantages will become clear from the description of an embodiment that is shown schematically in the drawings. In the drawings.

SPECIFIC DESCRIPTION OF THE INVENTION

Figure 1:
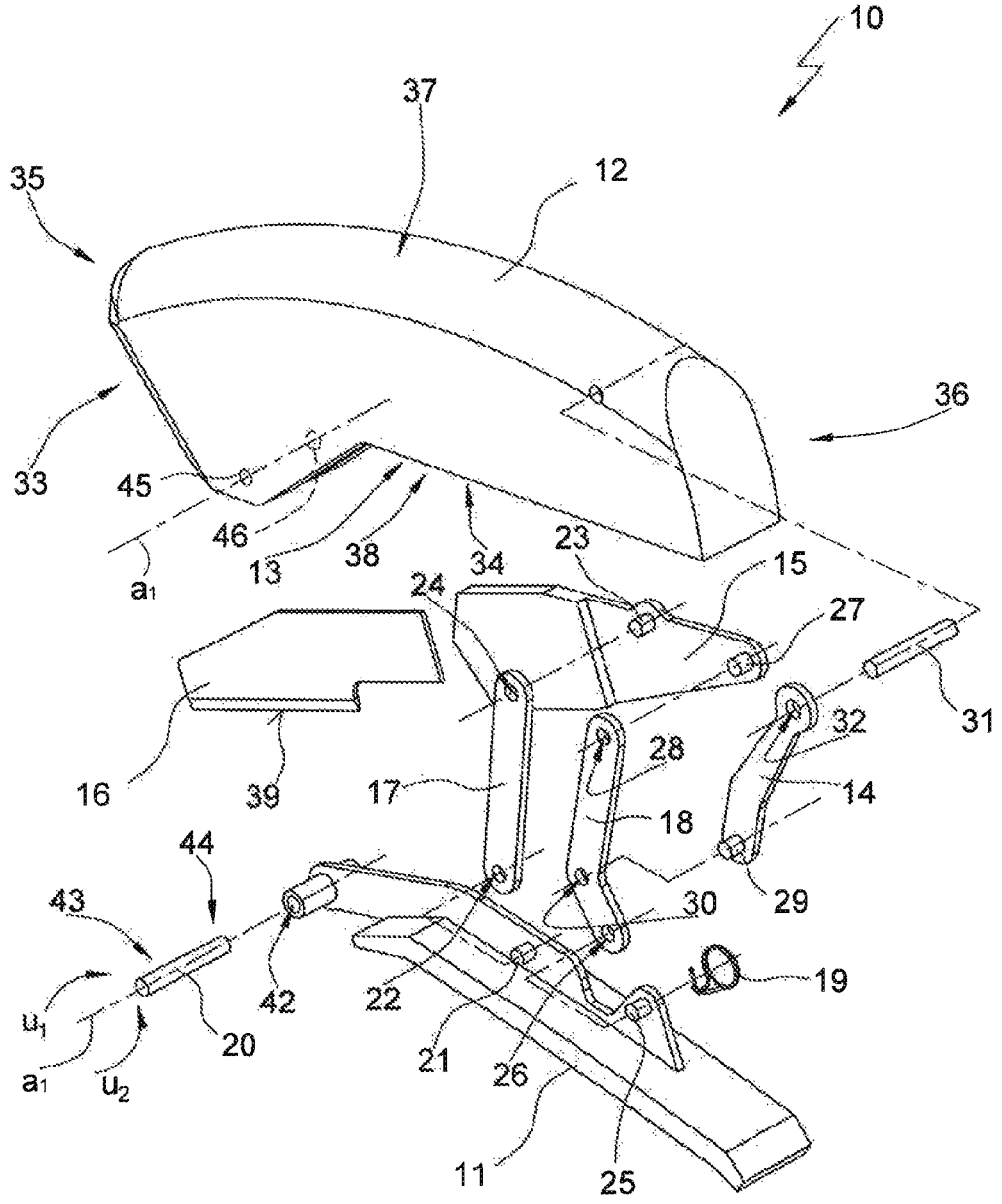
FIG. 1 is an exploded view of the utility knife.

Two embodiments of the invention are described by way of example in the following description of the figures, again with reference to the schematic drawings. In this case, for the sake of clarity, even in relation to different embodiments, the same or comparable parts or elements or regions are denoted by the same reference signs, sometimes with the addition of small letters.

Features that are described, shown or disclosed only in one embodiment can also be provided within the context of the invention in any other embodiment of the invention. Embodiments amended in this way are also covered by the invention, even if they are not shown in the drawings.

All the features disclosed are essential to the invention in their own right. The entire scope of the content of the disclosure of the cited documents and the described devices of the prior art is hereby also incorporated in the disclosure of the application, also for the purpose of incorporating individual or a plurality of features of the subjects disclosed therein into one or into a plurality of aspects of the present application. Embodiments amended in this way too are also covered by the invention, even if they are not shown in the drawings.

According to FIG. 1, the utility knife 10 comprises a lever 11 and a housing 12 pivoted together at a pivot $G_1$ having an axis $a_1$. The housing 12 can be pivoted in a direction $u_1$ toward the lever 11 or in the direction $u_2$ away from this lever 11. In the present embodiment, the relative movement between the lever 11 and the housing 12 is used for actuating the utility knife.

The housing 12 forms a chamber 13. The housing 12 protects the user from injury from a cutting edge 39 of the utility knife 10 when the cutting edge 39 is inside the chamber 13 and from injury on functional parts. Furthermore, the utility knife is protected from impairment of the mechanism such that reliable functioning is ensured.

The housing 12 has a front end 35 and a rear end 36. Furthermore, the utility knife forms an upper edge 37 and a lower edge 38. In this embodiment, the housing 12 is provided with openings 33 and 34. The opening 33 is at the front end 35 and is intended for the emergence of a blade 16. The opening 34 is formed on the lower edge 38 and allows for links 17 and 18 to extend through the edge of the housing 12.

The utility knife 10 is provided with a blade assembly that comprises the blade 16 and a blade support 15. The blade 16 is held firmly on the blade support 15 so as to be immovable relative to the blade support 15. The blade 16 can be released from the blade support 15 and replaced by another blade.

The utility knife 10 furthermore comprises an actuator that can move the blade assembly relative to the lever 11 and to the housing 12 between a rear end position and a front end position. The actuator comprises the links 17 and 18. The link 17 forms together with the lever 11 a lower pivot $G_2$ having a lower axis $a_2$ and together with the blade support 15 an upper pivot $G_3$ having an upper axis $a_3$. The link 18 forms together with the lever 11 a lower pivot $G_4$ having a lower axis $a_4$ and together with the blade support 15 and another upper pivot $G_7$ having an upper axis $a_5$. Alternatively, the links 17 and 18 can also form a pivot directly with the blade 16.

Figure 2A:
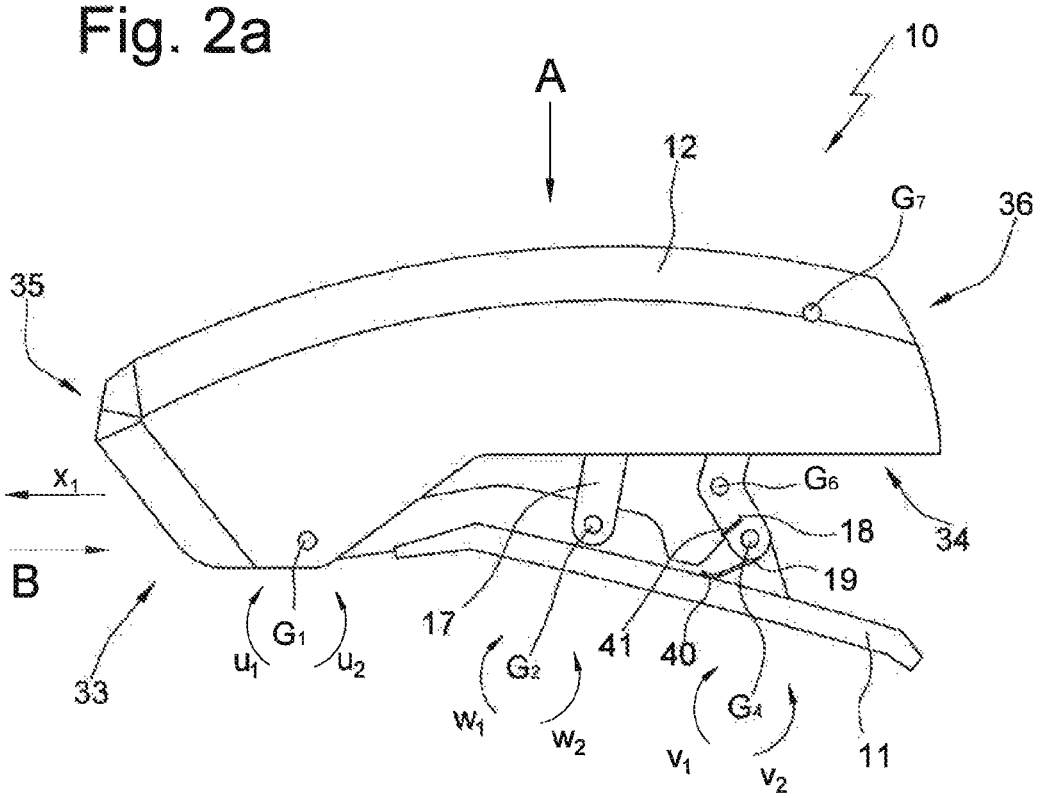
FIG. 2*a* is a side view of the unactuated utility knife with a blade assembly in the rear end position.

A brace 14 (see FIG. 2*a*) forms with the link 18 a pivot $G_6$ having an axis $a_6$ and with the housing 12 a pivot $G_7$ having an axis $a_7$. The brace 14 limits the degree of freedom of the mechanical linkage.

The pivot axes $a_1$ to $a_7$ of the pivot pivots $G_1$ to $G_7$ are oriented so as to be substantially at right angles to a longitudinal axis $m_1$ of the housing 12. The pivot $G_1$ (see FIG. 1) is formed by a first axle 20 that passes through a pivot hole 42 in the lever 11 and is anchored at both ends 43 and 44 in holes 45 and 46 on opposite walls of the housing 12.

The lower pivot $G_2$ is formed by a trunnion 21 of the lever 11 that engages in an end hole 22 in the link 17, and the upper pivot $G_3$ is formed by a trunnion 23 of the blade support 15 that engages in another end hole 24 in the link 17. Furthermore, the lower pivot $G_4$ is formed by a trunnion 25 of the lever 11 that engages in an end hole 26 in the link 18, and the upper pivot $G_5$ is formed by a trunnion 27 of the blade support 15 that engages in an end hole 28 in the link 18.

The brace 14 has a trunnion 29 that engages in a hole 30 of the link 18 in order to form the pivot $G_6$ and an axle 31 that is fastened at both ends on opposing walls of the housing 12 and that passes through a hole 32 of the brace 14 to form the pivot $G_7$.

Figure 4:
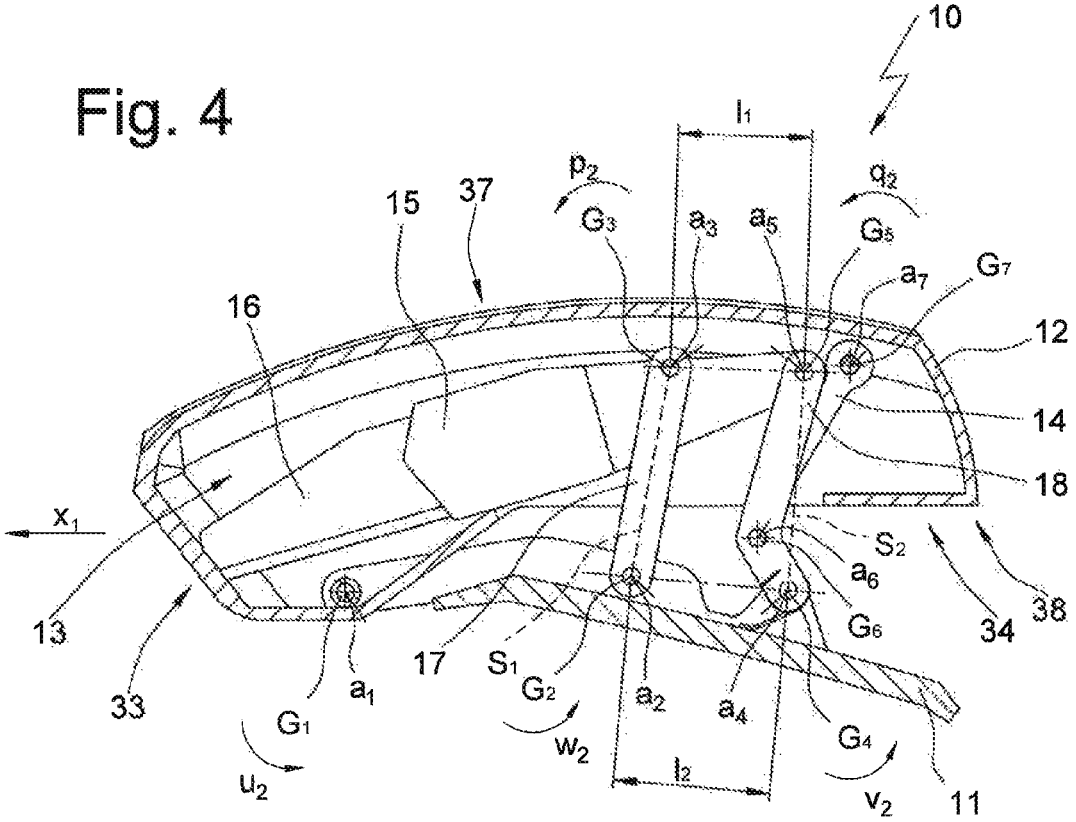
FIG. 4 is a section taken along section line D-D in FIG. 2*b* showing the blade assembly in the rear end position.

It can be seen in FIG. 4, for example, that a spacing $I_1$ between the upper pivots $G_3$ and $G_5$ does not correspond to the spacing $I_2$ between the pivots $G_2$ and $G_4$. A connecting line $S_1$ between the pivots $G_2$ and $G_3$ is not parallel to a connecting line $S_2$ between the pivots $G_4$ and $G_5$, i.e. the four-bar linkage formed by the lever 11, the links 17 and 18 and the housing 12 is a asymmetrical. In this way, an advantageous movement path of the blade support 15 can be achieved that allows for a relatively slim housing.

A spring 19 is supported by its one end 40 (see FIG. 2*a*) on the lever 11 and by another spring end 41 on the link 18. The link 18 is urged by the spring 19 in the direction of rotation $v_1$.

In this way, the blade assembly comprising the blade support 15 and the blade 16 can be moved relative to the lever 11 between the front end position and the rear end position using the actuator. The lever 11, the blade support 15 and the links 17 and 18 form a mechanical linkage. The blade support 15 can be moved relative to the lever 11 through a coupler curve between a rear end position and a front end position. The blade support 15 is mounted exclusively on the links 17 and 18, i.e. it has no direct contact with the housing 12 during movement between the rear and the front end position.

Figure 3A:
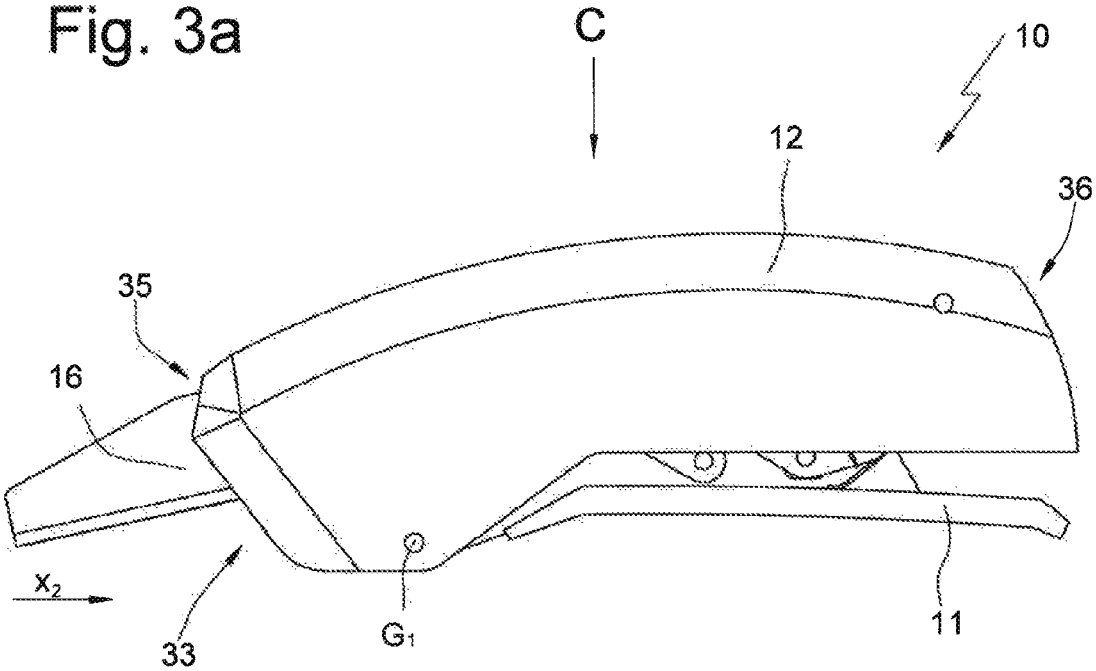
FIG. 3*a* is a side view according to FIG. 2*a* in the actuated position.
Figure 2B:
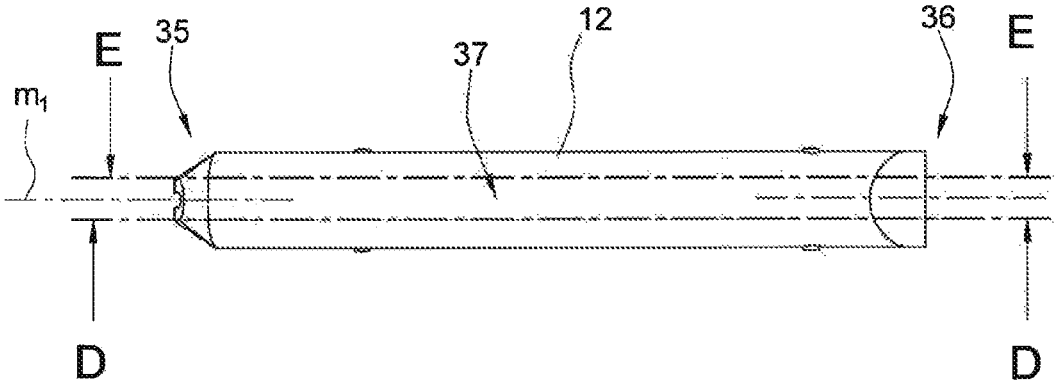
FIG. 2*b* is a plan view according to the arrow A in FIG. 2*a*.
Figure 3B:
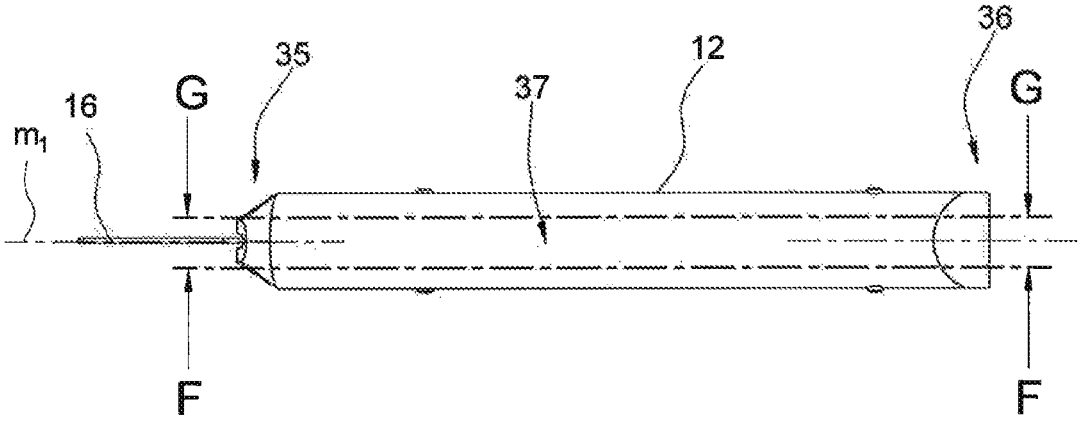
FIG. 3*b* is a plan view according to the arrow C in FIG. 3*a*.
Figure 5:
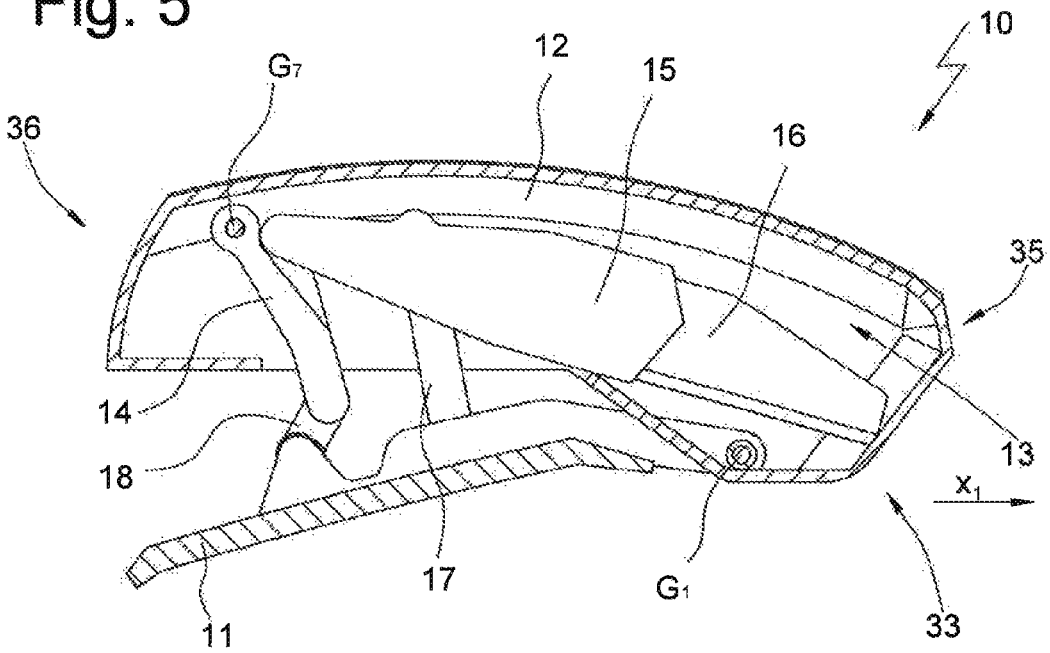
FIG. 5 is a section taken along section line E-E in FIG. 2*b*.
Figure 6A:
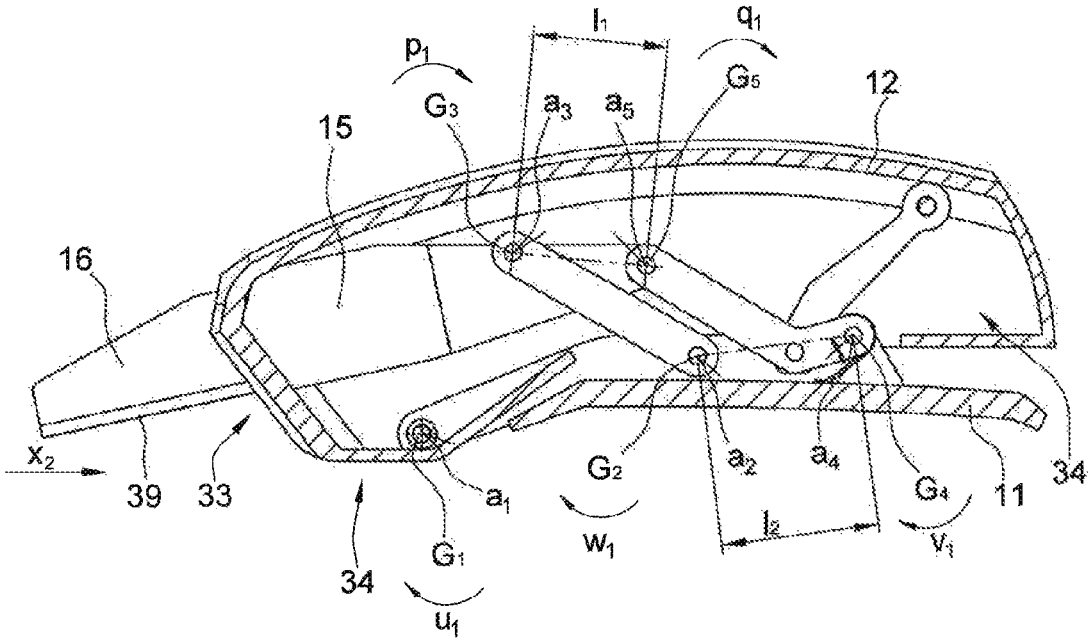
FIG. 6*a* is a section taken along section line F-F in FIG. 3*b* with the blade assembly in the front end position.
Figure 7:
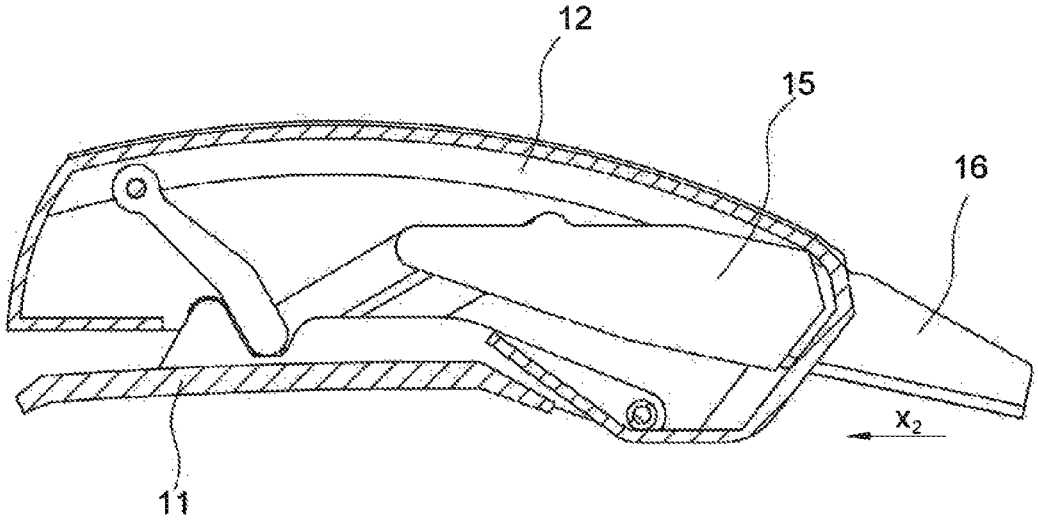
FIG. 7 is a section according to the section line G-G in FIG. 3*b*.

The front end position is a cutting position in which the blade 16 projects out of the housing 12 such that a cutting process can be performed, and the rear end position is a safety position in which the cutting edge 39 of the blade 16 is protected by the housing 12 so as to be inaccessible to a user. The safety position is shown in FIGS. 2, 4 and 5, and the cutting position is shown in FIGS. 3, 6 and 7.

In the case of a movement of the housing 12 relative to the lever 11 in the direction $u_1$ the brace 14 applies a force against the link 18 that pivots the link 18 relative to the housing 12 about the axis $a_4$ in the direction $v_2$. In the process, as a result of the motion coupling of the mechanical linkage, the link 17 is also pivoted relative to the housing 12 about the axis $G_2$ in the direction $w_2$. The two links 17 and 18 also move the blade assembly through the coupler curve.

In the cutting position according to FIGS. 6 to 9, the cutting edge 39 of the blade 16 projects out of the opening 33 of the housing 12. When a force F is applied to the cutting edge 39 of the blade 16, the blade 16 can be supported on a support surface 48 of the edge of the opening 33. The force F then generates in the link 17 a torque in the direction $w_2$ about the axis $a_2$ and in the link 18 a torque in the direction $v_2$ about the axis $a_4$. These torques reduce the retaining force for holding the blade support 15 in the front end position or in another cutting position.

Figure 6B:
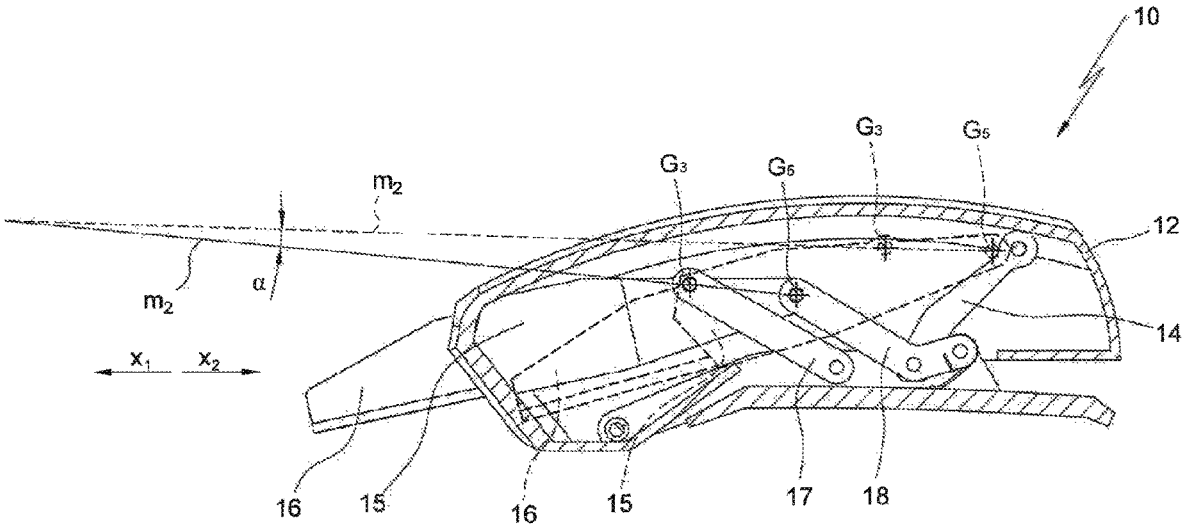
FIG. 6*b* is a section according to FIG. 6*a* with the position of the blade support in the rear end position according to FIG. 4 in dashed lines and the angular change of the blade shown.
Figure 8:
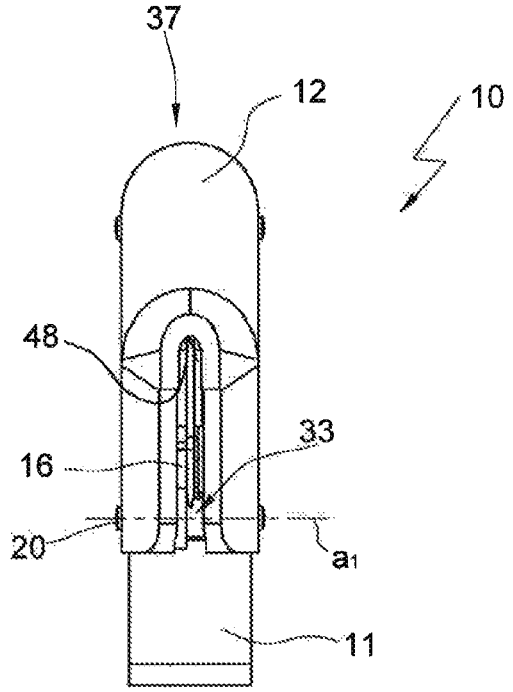
FIG. 8 is a view according to the arrow B in FIG. 2*a*.
Figure 9:
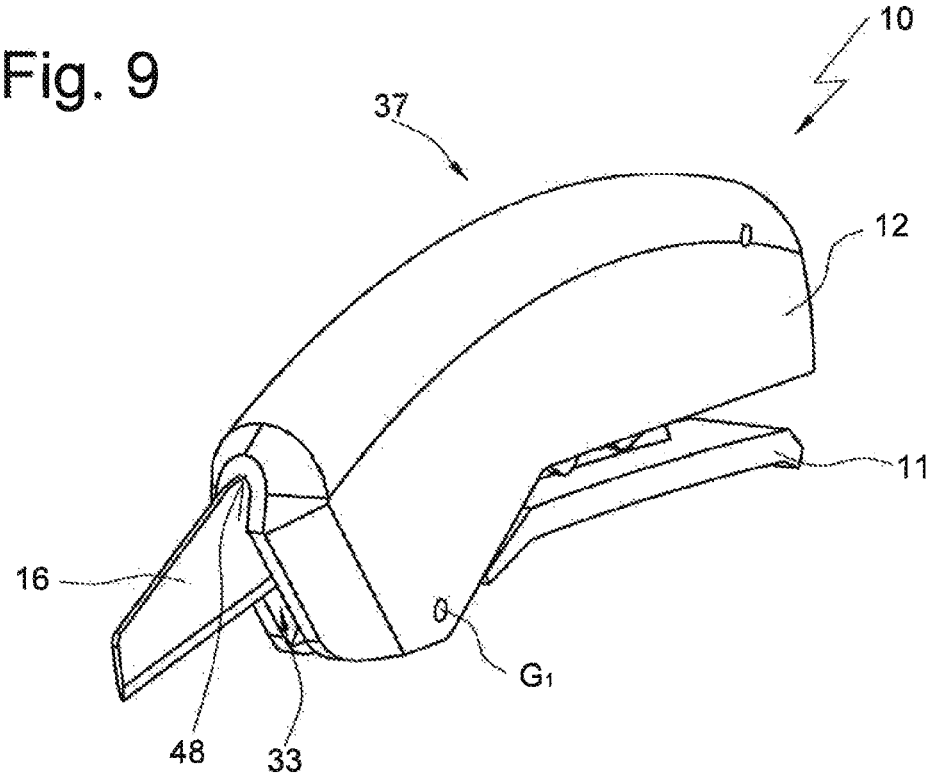
FIG. 9 is a perspective view of the utility knife from the front with the blade assembly in the front position.
Figure 10:
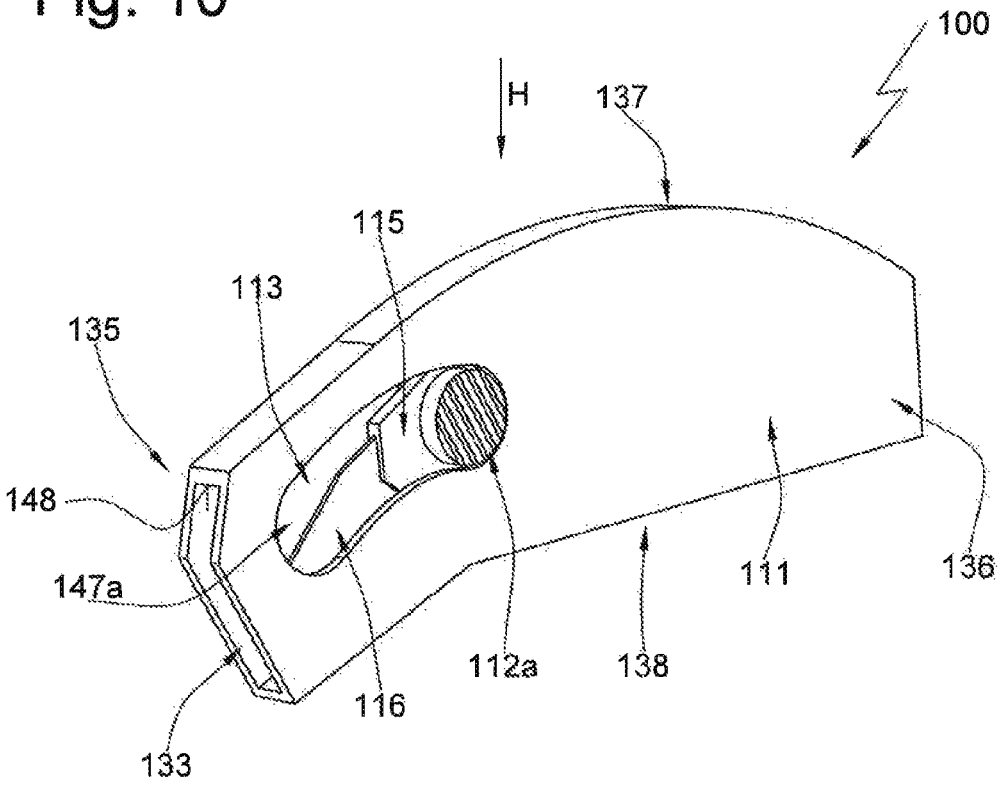
FIG. 10 is a perspective view of a second embodiment of the utility knife according to the invention with the blade assembly in the rear end position.

FIG. 6*b* shows that a straight line $m_2$ through the upper pivots $G_3$ and $G_5$ of the blade assembly comprising the blade 16 and the support 15 is pivoted by just a small angle $\alpha$ during movement between the rear position and the front position. This is a result of the nonparallel orientation and the different lengths of the links 17 and 18.

This action provides the advantage that the housing can be designed so as to be relatively slim. Furthermore, an advantage is achieved with respect the safety of the utility knife because the blade emerges from the lever only through a narrow slot, specifically the utility knife opening 33. After the blade 16 has emerged from the housing-like housing 12, the blade 16 executes just a slight rotational movement.

The functional sequence will be described in the following:

When the utility knife 10 is actuated in the rear end position of the blade support 15, i.e. in the case of relative movement of the lever 11 with respect to the housing 12 in the direction $u_1$, the brace 14 applies a force to the pivot $G_6$ that generates a torque in the link 18 about the axis $G_4$ in the direction $v_2$ and moves the link 18 in the direction $v_2$. In the case of rotation of the link 18 about the pivot $G_4$ in the direction $v_2$, the link 17 that is movably connected by the mechanical linkage moves about the pivot $G_2$ in the angular direction $w_2$. In the process, the blade support 15 is moved counter to the restoring force of the spring 19 into the cutting position in the direction $x_1$ over a movement path (or coupler curve) that is brought about by the four-bar linkage, and the link 17 rotates about the axis $a_3$ in the direction $p_2$ and the link 18 rotates relative to the blade support 15 about the axis $a_5$ in the direction $q_2$.

When the lever 11 and the housing 12 are unloaded, the spring 19 relaxes such that the link 18 pivots about the axis $a_4$ in the direction $v_1$ and the link 17 pivots about the axis $a_2$ in the direction $w_1$. The link 17 pivots relative to the blade support about the axis $a_3$ in direction $p_1$ and the link 18 pivots relative to the blade support 15 about the axis $a_5$ in direction $q_1$. The brace 14 moves the housing 12 relative to the lever 11 in the direction $u_1$. In the process, the blade support 15 moves back into the safety position in the direction $x_2$.

A second embodiment of the utility knife according to the invention is shown in FIGS. 10 to 15 and is denoted overall by reference 110.

The utility knife 110 comprises a housing 111 that forms the lever within the meaning of the invention, and an actuator comprising actuation attachments 112*a* and 112*b*. The actuator forms the housing within the meaning of the invention. The housing 111 forms a chamber 113 holding a movable blade support 115 carrying a blade 116. The housing 111 comprises a front end 135 and a rear end 136. Furthermore, the utility knife forms an upper edge 137 and a lower edge 138.

Figure 11:
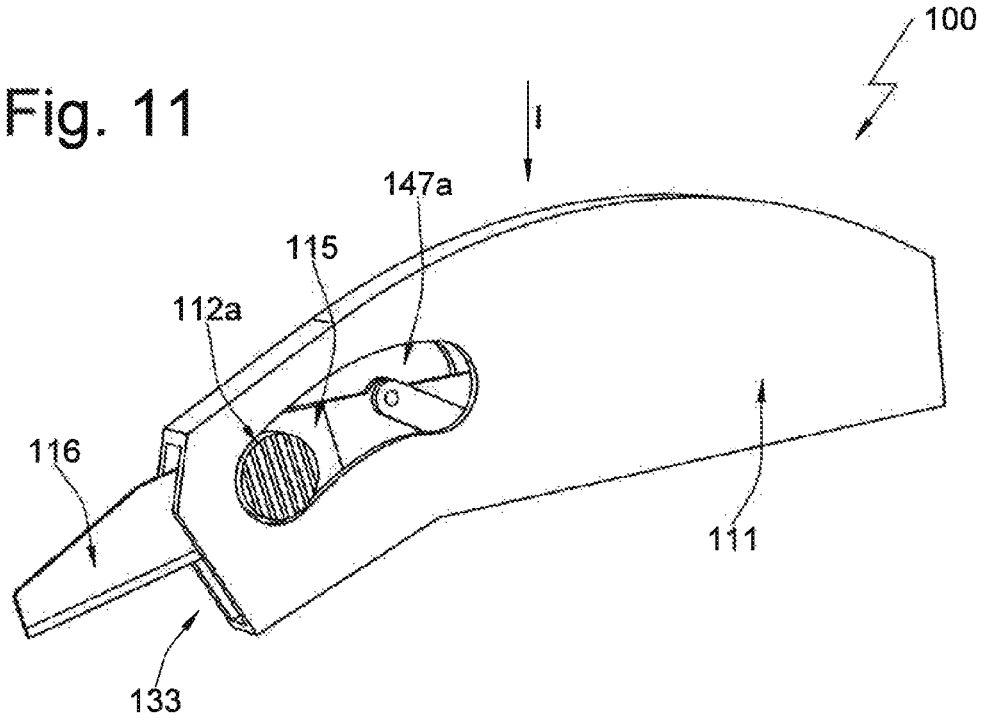
FIG. 11 is a view like FIG. 10 with the blade assembly in the front end position.
Figure 12:
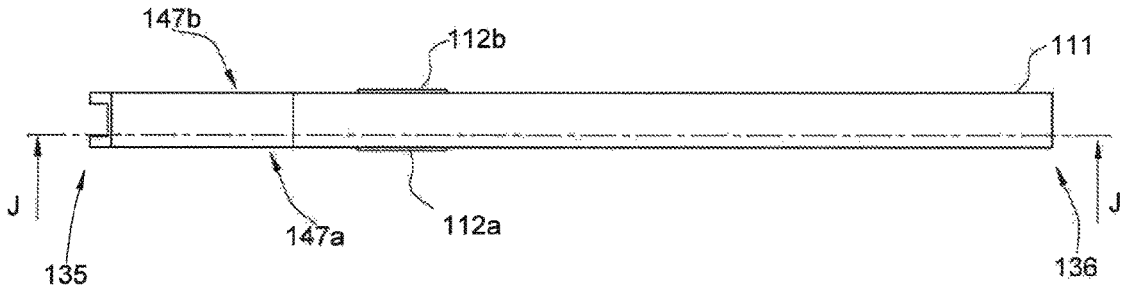
FIG. 12 is a plan view of the utility knife according to arrow H in FIG. 10.
Figure 13:
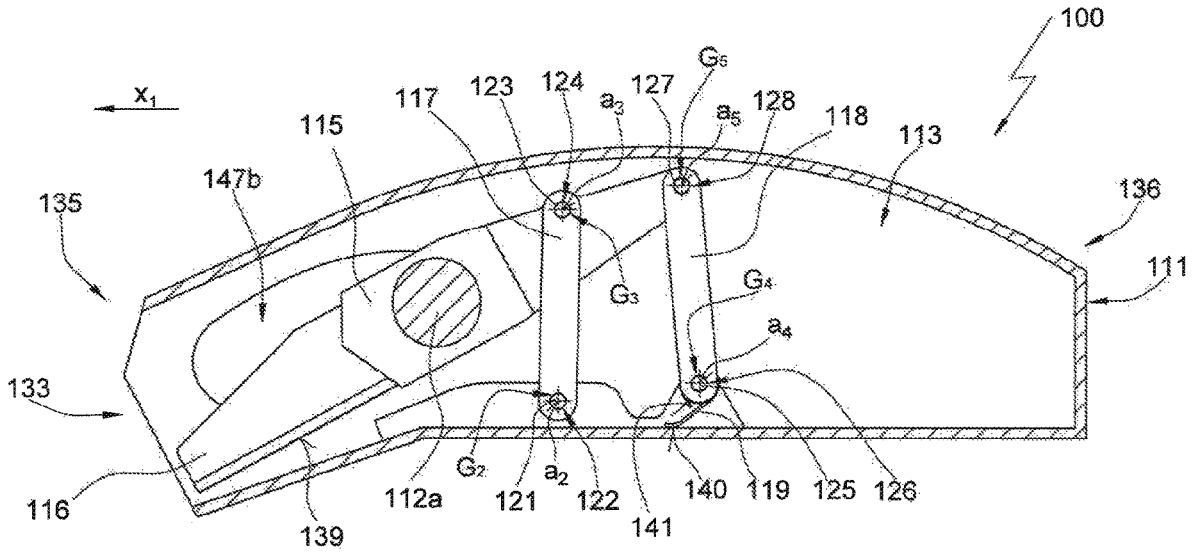
FIG. 13 is a section taken along section line J-J in FIG. 12.
Figure 14:
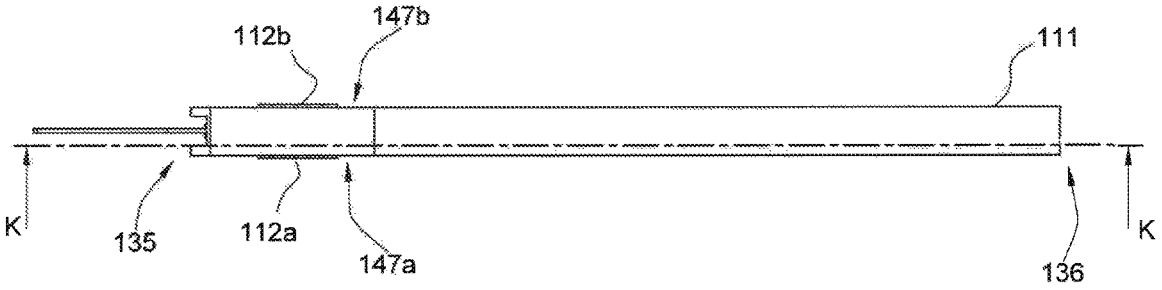
FIG. 14 is a plan view of the utility knife according to arrow I in FIG. 11.
Figure 15:
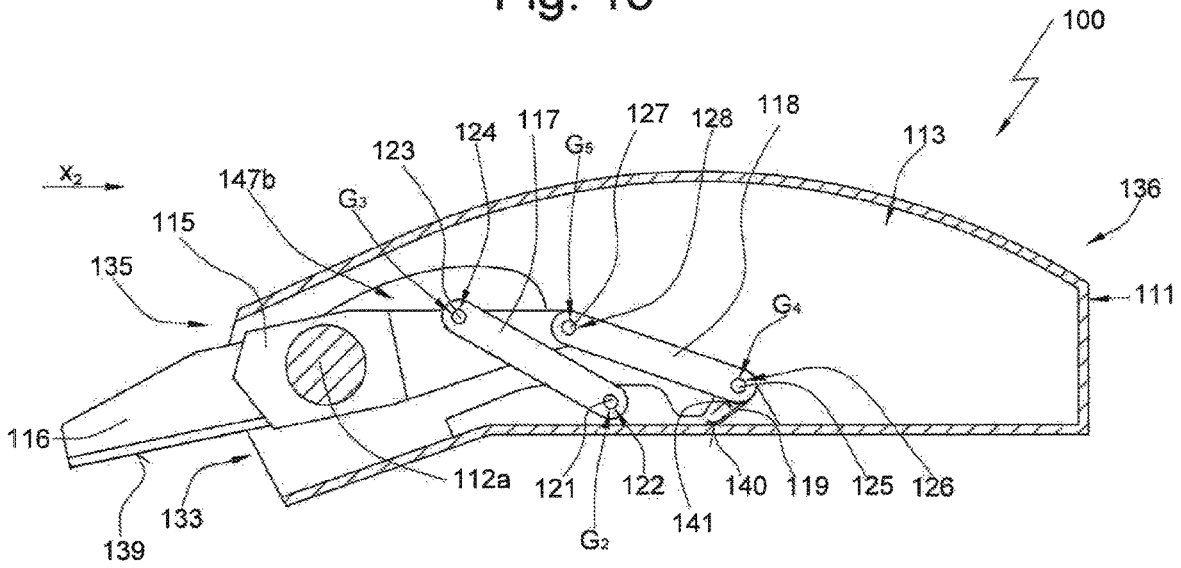
FIG. 15 is a section taken along section line K-K in FIG. 14.

The blade support 115 is movable between a rear end position (see FIGS. 1 and 3) and a front end position (see FIGS. 11 and 13). The rear end position is a safety position in which the blade 116 is in the chamber 113 so as to be inaccessible for a user, and the front end position is a cutting position in which the blade 116 projects out of an opening 133 of the housing 112. Apart from the rear end position and the front end position, there are further safety positions of the blade assembly and further cutting positions. The opening 133 is provided on the front end 135 of the housing 111. The edge of the opening 133 forms a support surface 148 for the blade 116.

The actuation attachments 112*a* and 112*b* are actuated via arcuate thoroughgoing guide slots 147*a* and 147*b* in the housing 111. The fact that the user moves the blade support 115 forward in a direction $x_1$ via the actuation attachments 112*a* or 112*b* causes the blade assembly comprising the blade support 115 and the blade 116 to be displaced out of the safety position shown in FIG. 10 and into the cutting position shown in FIG. 11. The front end position is defined by when the actuation attachments 112*a* and 112*b* abut front ends of the slots 147*a* and 147*b*. As soon as the user removes the load form the relevant actuation attachment 112*a* or 112*b*, the blade support 115 is moved back into the safety position by a return spring.

The blade assembly can be moved between the rear end position and the front end position using an actuator. The actuator comprises links 117 and 118. The link 117 forms together with the housing 112 the lower pivot $G_2$ having the axis $a_2$ and together with the blade assembly, or in this embodiment the blade support 115, the upper pivot $G_3$ having the axis $a_3$. The link 118 forms together with the housing 112 the lower pivot $G_4$ having the axis $a_4$ and together with the blade assembly the upper pivot $G_5$ having the axis $a_5$. According to an alternative, the blade support 115 could also be omitted and the links 117 and 118 would in this case pivot directly on the blade 116.

The lower pivot $G_2$ is formed by a trunnion 121 of the housing 112 that engages in a hole 122 in the link 117, and the upper pivot $G_3$ is formed by a trunnion 123 of the blade support 115 that engages in a hole 124 in the link 117. Furthermore, the lower pivot $G_4$ is formed by a trunnion 125 of the lever 111 that engages in a hole 126 in the link 118, and the upper pivot $G_5$ is formed by a trunnion 127 of the blade support 115 that engages in a hole 128 in the link 118. The spacing between the pivots $G_3$ and $G_5$ is smaller than between the pivots $G_2$ and $G_4$.

The utility knife 110 thus forms a mechanical linkage (see FIG. 13) that comprises the housing 111, the blade support 115, and the links 117 and 118. On movement of the blade support 115 by one of the actuation attachments 112*a* or 112*b*, all the movably connected parts of the mechanical linkage are moved. By relative movement between the actuation attachment 112*a* or 112*b* and the housing 111, the blade support 115 can be moved between the rear end position and the front end position.

The blade support 115 is guided through a coupler curve by the mechanical linkage so that the blade support assumes a defined position at each point of the coupler curve. During movement between the rear end position and the front end position, the blade support does not need to be guided on the lever 111. In the present embodiment, the blade support 115 is guided exclusively by the links 117 and 118. Only in the case of elastic deformation of the links 117 and 118 owing to high loading of the blade 116, is it possible that the blade support 115 may be supported on the inside wall of th housing formed by the lever 111.

The coupler curve is designed such that a straight line $m_2$ through the pivots $G_3$ and $G_5$ pivots by no more than 45° during movement between the rear end position and the front end position. This feature ensures that the housing 112 is designed so as to be relatively slim such that the housing 112 can be easily held by one hand and that the blade 116 performs just a small pivot movement after emerging from the opening 133 as a result of which increased safety is achieved.

A spring 119 is supported on the housing 111 by one spring end 140 and on the link 118 by another spring end 141. The link 118 is urged by the spring 119 in the direction $v_2$ and the entire mechanical linkage including that of the blade support 115 is urged into the rear end position.

The mode of operation of the utility knife 110 will be described in the following:

Actuation of the blade support via one of the actuation attachments 112*a* or 112*b* moves the blade assembly between the rear end position and the front end position with the link 117 pivoting relative to the housing 111 about the axis $a_2$ in the direction $w_2$ and the link 118 pivoting relative to this housing about the axis $a_4$ in the direction $v_2$. The blade support 115 pivots relative to the link 117 about the axis $a_3$ and relative to the link 118 about the axis $a_5$. In the process, the blade support 115 and the blade 116 fastened therein are moved along the coupler curve and into the cutting position counter to the restoring force of the spring 119.

When the actuation attachment 112*a* or 112*b* is released, the spring 119 moves the link 118 in the direction $v_1$ and the link 117 moves in the direction $w_1$. In the process, the blade support is moved along coupler curve in the direction $x_2$ and back into the rear end position.

The invention claimed is:

1. A utility knife comprising:

a housing having a longitudinally open front end, a blade assembly including a blade and being movable in the housing between a front end position and a rear end safety position, a lever pivoted on the housing, two links each having one end pivoted on the blade assembly and an opposite end pivotal on the lever, the links pivotally interconnecting the blade assembly and the lever for relative movement of the blade assembly and the housing between the rear end safety position with the blade inside the housing and the front end position with the blade projecting longitudinally forward from the front end of the housing, the one ends or the opposite ends being spaced from one another to define separate pivot axes; and spring means connected to the links and urging the blade assembly into the rear end safety position.

2. The utility knife according to claim 1, wherein each link has only one direction of rotation during the relative movement of the blade assembly between the rear end safety position and the front end position.

3. The utility knife according to claim 1, wherein the two links have the same direction of rotation during the relative movement of the blade assembly between the rear end safety position and the front end position.

4. The utility knife according to claim 1, wherein the housing protects the blade from contact with a user of the knife at least in the rear end safety position.

5. The utility knife according to claim 1, further comprising:

a brace pivotally connected to one of the links and to the housing such that, during the relative movement between the housing and the lever, the blade assembly is moved from the rear end safety position into the front end position or into an intermediate position between the rear end safety position and the front end position.

6. The utility knife according to claim 1, wherein the lever is pivotable in a first direction out of a home position into an actuated position in order to move the blade assembly from the rear end safety position into the front end position for cutting.

7. The utility knife according to claim 1, wherein the blade assembly performs a pivot movement of $\alpha<45°$ during the relative movement the rear end safety position and the front end position.

8. The utility knife according to claim 1, wherein the lever is pivotal on the housing between an actuated position close to the housing and corresponding to the front end position and an open position separated from the housing and corresponding to the rear end safety position.

* * * * *